US007963518B2

(12) United States Patent
Moore

(10) Patent No.: US 7,963,518 B2
(45) Date of Patent: Jun. 21, 2011

(54) PRINTING SYSTEM INVERTER APPARATUS AND METHOD

(75) Inventor: Steven R. Moore, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1172 days.

(21) Appl. No.: 11/331,627

(22) Filed: Jan. 13, 2006

(65) Prior Publication Data

US 2007/0164504 A1 Jul. 19, 2007

(51) Int. Cl.
*B65H 29/66* (2006.01)

(52) U.S. Cl. ..... 271/65; 271/186

(58) Field of Classification Search ..... 271/65, 271/186, 298, 302

See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,106,075 A * 4/1992 Wafford et al. ..... 271/186
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.
5,884,910 A 3/1999 Mandel
5,995,721 A 11/1999 Rourke et al.
6,059,284 A 5/2000 Wolf et al.
6,125,248 A 9/2000 Moser
6,241,242 B1 6/2001 Munro
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner* — Michael C McCullough
(74) *Attorney, Agent, or Firm* — Fay Sharpe LLP

(57) ABSTRACT

A media sheet inverter apparatus and method is disclosed. The media sheet inverter, according to one embodiment of the disclosure, comprises an input nip configured to receive a media sheet and a reversing roll nip configured to receive a media sheet from the input nip. The media sheet is subsequently held within the inverter for a predetermined time before being ejected to an output nip configured to receive the media sheet from the reversing roll nip. The inverter apparatus and method is especially suited to inverting alternating media sheets.

8 Claims, 8 Drawing Sheets

U.S. PATENT DOCUMENTS

| | | | | |
|---|---|---|---|---|
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 * | 8/2003 | Conrow | 399/364 |
| 6,612,566 | B2 * | 9/2003 | Stoll | 271/186 |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond, Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Datal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

PRINTING SYSTEM INVERTER APPARATUS AND METHOD

CROSS REFERENCE TO RELATED PATENTS AND APPLICATIONS

The following applications, the disclosures of each being totally incorporated herein by reference are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

Application Ser. No. 11/235,979, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

Application Ser. No. 11/236,099, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. application Ser. No. 10,761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Robert M. Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/109,996, filed Apr. 20, 2005, entitled "PRINTING SYSTEMS," by Michael C. Mongeon, et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,959, filed May 25, 2005, entitled "PRINTING SYSTEMS," by Kristine A. German, et al.;

U.S. application Ser. No. 11/137,634, filed May 25, 2005, entitled "PRINTING SYSTEM," by Robert M. Lofthus, et al.;

U.S. application Ser. No. 11/137,251, filed May 25, 2005, entitled "SCHEDULING SYSTEM," by Robert M. Lofthus, et al.;

U.S. C-I-P application Ser. No. 11/137,273, filed May 25, 2005, entitled "PRINTING SYSTEM," by David G. Anderson, et al.;

U.S. application Ser. No. 11/143,818, filed Jun. 2, 2005, entitled "INTER-SEPARATION DECORRELATOR," by Edul N. Dalal, et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof, et al.;

U.S. application Ser. No. 11/11/156,778, filed Jun. 20, 2005, entitled "PRINTING PLATFORM," by Joseph A. Swift;

U.S. Patent Application Publication No. 2006/0285159, published Dec. 21, 2006, entitled "METHOD OF ORDERING JOB QUEUE OF MARKING SYSTEMS," by Neil A. Frankel;

U.S. application Ser. No. 11/166,460, filed Jun. 24, 2005, entitled "GLOSSING SUBSYSTEM FOR A PRINTING DEVICE," by Bryan J. Roof, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/170,845, filed Jun. 30, 2005, entitled "HIGH AVAILABILITY PRINTING SYSTEMS," by Meera Sampath, et al.;

U.S. application Ser. No. 11/189,371, filed Jul. 26, 2005, entitled "PRINTING SYSTEM," by Steven R. Moore, et al.;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM", by Eric Hamby, et al.;

U.S. application Ser. No. 11/222,260, filed Sep. 8, 2005, entitled "METHOD AND SYSTEMS FOR DETERMINING BANDING COMPENSATION PARAMETERS IN PRINTING SYSTEMS", by Goodman, et al.;

U.S. application Ser. No. 11/234,553, filed Sep. 23, 2005, entitled "MAXIMUM GAMUT STRATEGY FOR THE PRINTING SYSTEMS", by Michael C. Mongeon;

U.S. application Ser. No. 11/234,468, filed Sep. 23, 2005, entitled "PRINTING SYSTEM", by Eric Hamby, et al.;

U.S. application Ser. No. 11/247,778, filed Oct. 11, 2005, entitled "PRINTING SYSTEM WITH BALANCED CONSUMABLE USAGE", by Charles Radulski, et al.;

U.S. application Ser. No. 11/248,044, filed Oct. 12, 2005, entitled "MEDIA PATH CROSSOVER FOR PRINTING SYSTEM", by Stan A. Spencer, et al.; and U.S. Patent Application Publication No. 2007/0110301, published May 17, 2007, entitled "GAMUT SELECTION IN MULTI-ENGINE SYSTEMS", by Wencheng Wu, et al.;

U.S. Pat. No. 7,280,771, issued Oct. 9, 2007, entitled "MEDIA PASS THROUGH MODE FOR MULTI-ENGINE SYSTEM", by Barry P. Mandel, et al., U.S. Pat. No. 7,519,314, issued Apr. 14, 2009, entitled "MULTIPLE IOT PPHOTORECEPTOR BELT SEAM SYNCHRONIZATION", by Kevin M. Carolan;

U.S. Pat. No. 7,575,232, issued Aug. 18, 2009, entitled "MEDIA PATH CROSSOVER CLEARANCE FOR PRINTING SYSTEM", by Keith L. Willis;

U.S. Patent Application Publication No. 2007/0120933, published May 31, 2007, entitled "PRINTING SYSTEM", by David A. Mueller;

U.S. Patent Application Publication No. 2007/0120305, published May 31, 2007, entitled "RADIAL MERGE MODULE FOR PRINTING SYSTEM", by Barry P. Mandel, et al.;

U.S. application Ser. No. 11/291,583, filed Nov. 30, 2005, entitled "MIXED OUTPUT PRINTING SYSTEM", by Joseph H. Lang;

U.S. Patent Application Publication No. 2007/0140767, published Jun. 21, 2007, entitled "PRINTING SYSTEM ARCHITECTURE WITH CENTER CROSS-OVER AND INTERPOSER BY-PASS PATH", by Barry P. Mandel, et al.;

U.S. Patent Application Publication No. 2007/0140711, published Jun. 21, 2007, entitled "MEDIA PATH DIAGNOSTICS WITH HYPER MODULE ELEMENTS", by David G. Anderson, et al; and U.S. Patent Application Publication No. 2007/0139672, published Jun. 21, 2007, entitled "A METHOD AND APPARATUS FOR MULTIPLE PRINTER CALIBRATION USING COMPROMISE AIM", by R. Victor Klassen.

BACKGROUND

Printing systems including a plurality of printing modules, also referred to as marking modules, are known and can be generally referred to as tandem engine printers. Such systems especially facilitate expeditious duplex printing, i.e., printing on both sides of a media sheet or document, with the first side of a document being printed by one of the printing modules and the opposite, or second side, of the document being printed by a second printing module. The process path for the document usually requires an inversion of the document to facilitate printing on the second side of the document.

Media sheet inverters are well known and essentially comprise an arrangement of nip wheels or rollers which receive a document by extracting it from a main process path, then direct it back onto the process path after a 180 degree flip so that what had been the trailing edge of the document, now leaves the inverter as the leading edge along the main process path.

Inverters are thus fairly simple in their functional result; however, complexities occur as the printing system is required to handle different sizes and types of documents.

As a document is transported along its process path through the system, the document's precise position must be known and controlled. The adjustment of a document's position is generally controlled via a registration process and apparatus. Registration systems can comprise nip rolls in combination with document position sensors whereby the position sensors provide feedback control of the nip rolls to adjust the document to the desired position.

Regardless of the registration system employed to control the position of a document for subsequent printing, misregistration of images printed on a document can occur when multiple printing modules mark an image on a document or media sheet.

One example is a duplex printing operation utilizing two printing modules, whereby printed pages will be bound such that facing pages are printed using two printing modules. This situation occurs when the first side of all documents is printed with one printing module and the second side of all documents is printed with a second printing module. After the finished documents are sequentially bound, page two of the first document will face page one of the second document. Small misregistration of the printed images can become noticeable to a viewer due to registration inconsistencies between the printing modules and other hardware associated with the registration of the document prior to printing.

To eliminate small misregistration inconsistencies of printed images between printing modules, as described above, it is desirable to print the facing pages of a booklet-type bound collection of documents utilizing the same printing module. Usually, this involves an inverter placed at the output of a printing module before releasing the media sheet to an output device. The inverter inverts every second sheet, thereby arranging the printed documents at the output device such that facing pages are printed with the same printing module.

In practice, the time needed to invert a sheet is longer than the time needed for the sheet to simply bypass the inverter. Consequently, as a printed document is inverted, the subsequent printed documents, which will not be inverted, must be delayed in time to prevent them from advancing relative to the inverted document and crashing into it. The lower productivity associated with this delay is undesirable since it represents unused printing module capability. Some systems reduce the sheet delay by displacing the inverter further from the printing module, thus allowing sheets to speed up before entry to the inverter which reduces the cycle time of inverting a document. However, some print system architectures preclude this approach.

What is needed is a media sheet inverter apparatus and method to reduce timing delays associated with the operation of a duplex printing system as generally described above.

BRIEF DESCRIPTION

According to one aspect of this disclosure, a media sheet inverter apparatus is disclosed. The media sheet inverter apparatus comprising an input nip configured to receive a media sheet, a reversing roll nip configured to receive a media sheet from the input nip, hold the media sheet for a predetermined time, and eject the media sheet. An output nip operatively connected to the input nip is configured to receive the media sheet from the reversing roll nip and eject the media sheet. The reversing nip holds a first sheet while simultaneously a second sheet is delivered to the output nip from the input nip.

According to another aspect of this disclosure, a method of operating a media sheet inverter is disclosed. The method comprises receiving a first media sheet at an inverter input, inverting the first media sheet, and holding the first sheet within the inverter for a predetermined time, while allowing a second media sheet to pass without being inverted. Subsequently, the first media sheet is ejected at the inverter output, the first media sheet ejected from the inverter output subsequent to the second media sheet passing the inverter output.

According to another aspect of this disclosure, a printing system is disclosed. The printing system comprising an output inverter operatively connected to a printing module output, the output inverter configured to invert alternating media sheets. The inverter simultaneously inverts and holds a first media sheet while passing a second media sheet.

DETAILED DESCRIPTION

As briefly discussed in the Background section of this disclosure, printing systems comprising a printing module and a media sheet inverter located at the output of the printing module, suffer from a time delay if alternating sheets are inverted. The delay is a consequence of the inverter processing time being longer than that of the inverter bypass path.

In general, this disclosure provides an inverter and method of operating an inverter within a printing system to reduce timing delays associated with the inverter. According to one aspect of this disclosure, a printing system is disclosed that provides a duplex printing operation to produce documents printed on both sides, whereby the documents can be bound in a booklet fashion and facing pages are printed from the same printer.

Figure 1:
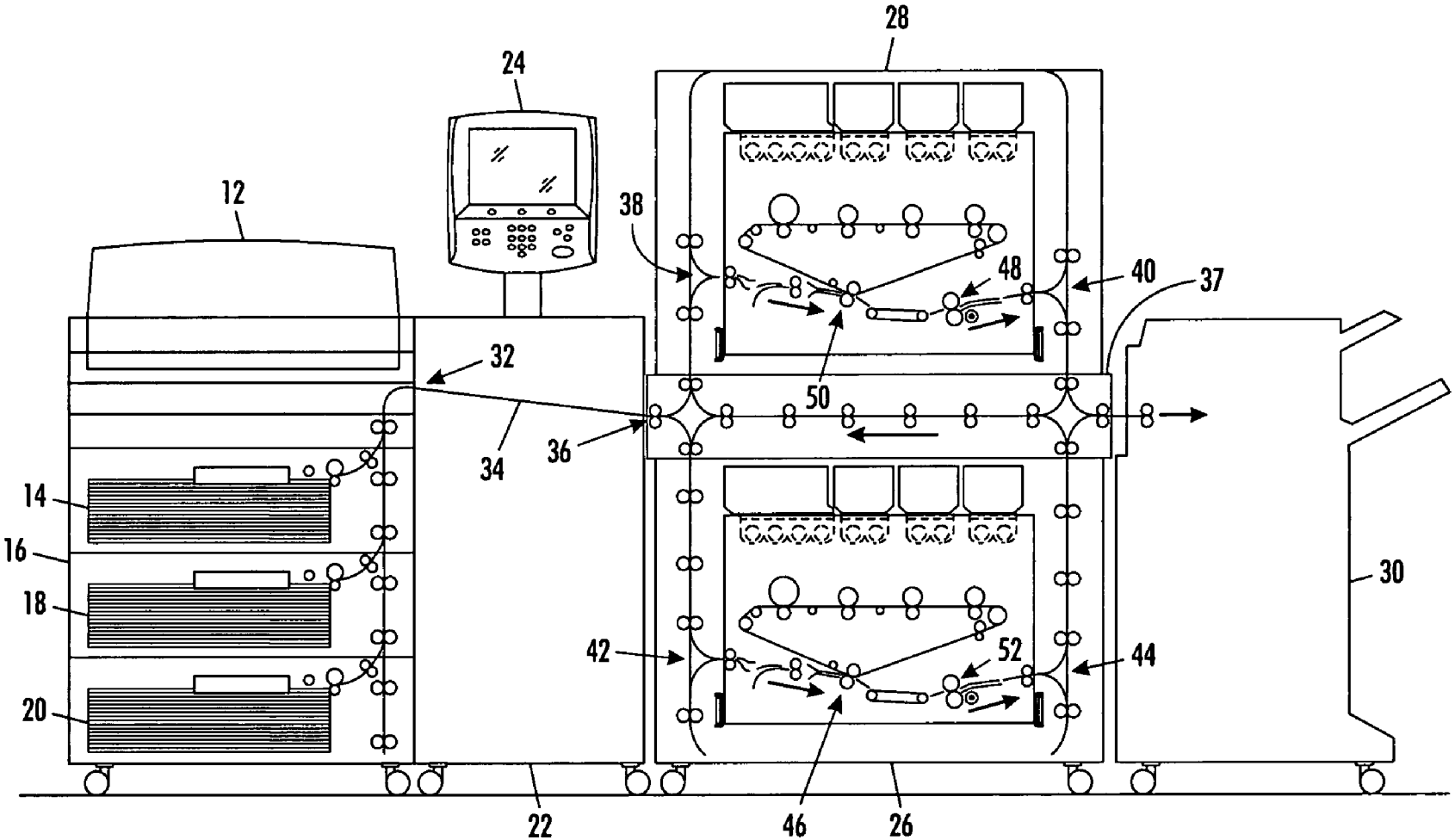
FIG. 1 illustrates a duplex printing system according to one embodiment of this disclosure.

With reference to FIG. 1, illustrated is a printing system according to one embodiment of this disclosure. The printing system comprises a sheet feeder module 16 including a scanner 12, a sheet feeder 14, another sheet feeder 18 and another sheet feeder 20. The feeder module 16 is operatively connected to a first interface module 22. Interface module 22 comprises a media sheet input 32 and media sheet output 36. A media sheet transportation system 34 integrates the feeder module 16 and a second interface module 37. Printing module 26 is operatively connected to interface module 37 to receive media sheets for printing and transporting printed media sheets to a finisher module 30 or a second printing module 28.

In addition to several nip rollers to transport media sheets within the printing module 26, printing module 26 includes an input inverter 42, an image marking zone 46, fuser 52 and output inverter 44. In general, media sheets can be routed from the feeder module 16 to printing module 26 via interface module 22 and interface module 37. A media sheet is subsequently routed through the image marking zone, in the direction of the arrows illustrated, and routed back to interface module 37. At this point, a printed media sheet is either routed to printing module 28 or to the finisher module 30.

Printing module 28 is operatively connected to interface module 37 and includes an input inverter 38, an image marking zone 50, a fuser 48 and an output inverter 40. In general, printing is accomplished similarly to the manner described with reference to printing module 26.

A user interface 24 provides a user with the ability to execute and control print jobs.

In general, FIG. 1 illustrates a printing system that includes vertically integrated printing modules. The two printing modules 26 and 28 enable a user to operate the printing system in a duplex mode, whereby one side of a document is printed with printing module 26 and the other side of the document is printed with printing module 28. Depending on the sequence of printing operations, processing the document through one or more of inverters 38, 40, 42 and 44, enables a collection of printed documents to be produced, whereby the printed documents are bound in a booklet form and facing pages are printed with the same printing module. As previously discussed, this will prevent noticeable image misregistration attributed to registration differences between the printing modules.

Below is a more detailed description of a printing system which comprises an inverter apparatus and method according to this disclosure.

Figure 2:
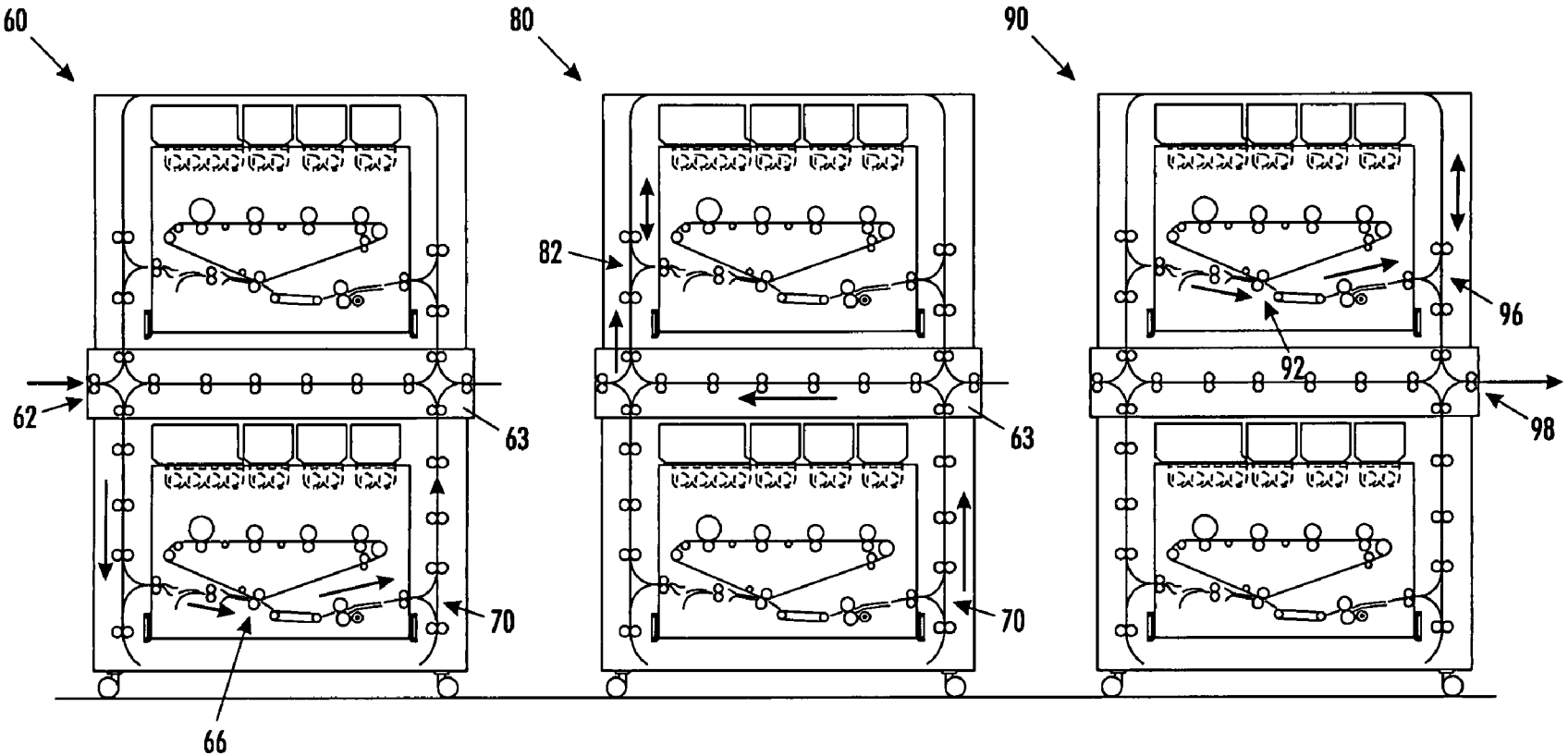
FIG. 2 illustrates a duplex printing operation according to another embodiment of this disclosure.

With reference to FIG. 2, illustrated is a sequence of stages representing an exemplary duplex operation to support an output producing a booklet-type document with facing pages printed on the same printing module.

During a first stage 60, a media sheet enters an interface module input 62, where it is subsequently routed to a first printing module image transfer zone 66 for printing on a first side of the media sheet. Subsequent to image transfer, the media sheet continues to travel through a fuser, and other image transfer hardware, towards an output inverter 70. The movements of a media sheet during this first stage are indicated as black arrows.

During a second stage 80, the media sheet continues to travel through the first printing module and the interface module 63, as indicated by the black arrows. The interface module 63 subsequently routes the media sheet to the second printing module input inverter 82. The media sheet is inverted by the inverter 82, which places the non-printed side of the media sheet face up.

During the third stage 90, the inverted media sheet is routed as indicated by the illustrated black arrows. Initially, the inverted media sheet is routed through the image marking zone 92 of the second printing module. After subsequent processing of the media sheet with associated image transfer hardware, the two sided printed media sheet is routed to an output inverter 96 which inverts the media sheet. The two sided printed media sheet is subsequently routed to the interface module output 98 with the first printed side of the media sheet face up.

The discussion provided thus far with reference to FIG. 2 has been limited to the duplex processing of a single media sheet. Now, a detailed description of a duplex printing operation which includes the duplex printing of multiple media sheets is provided. The duplex printing system described is a printing system which prints multiple two-sided documents capable of being bound in a booklet-type fashion; the facing pages of the printed documents being printed from the same printing module. This duplex printing system reduces noticeable image registration inconsistencies associated with facing pages being printed by two different printing modules. In addition, the duplex printing system reduces the delay time associated with inverting alternating documents, which increases the throughput of the printing system.

Figure 3:
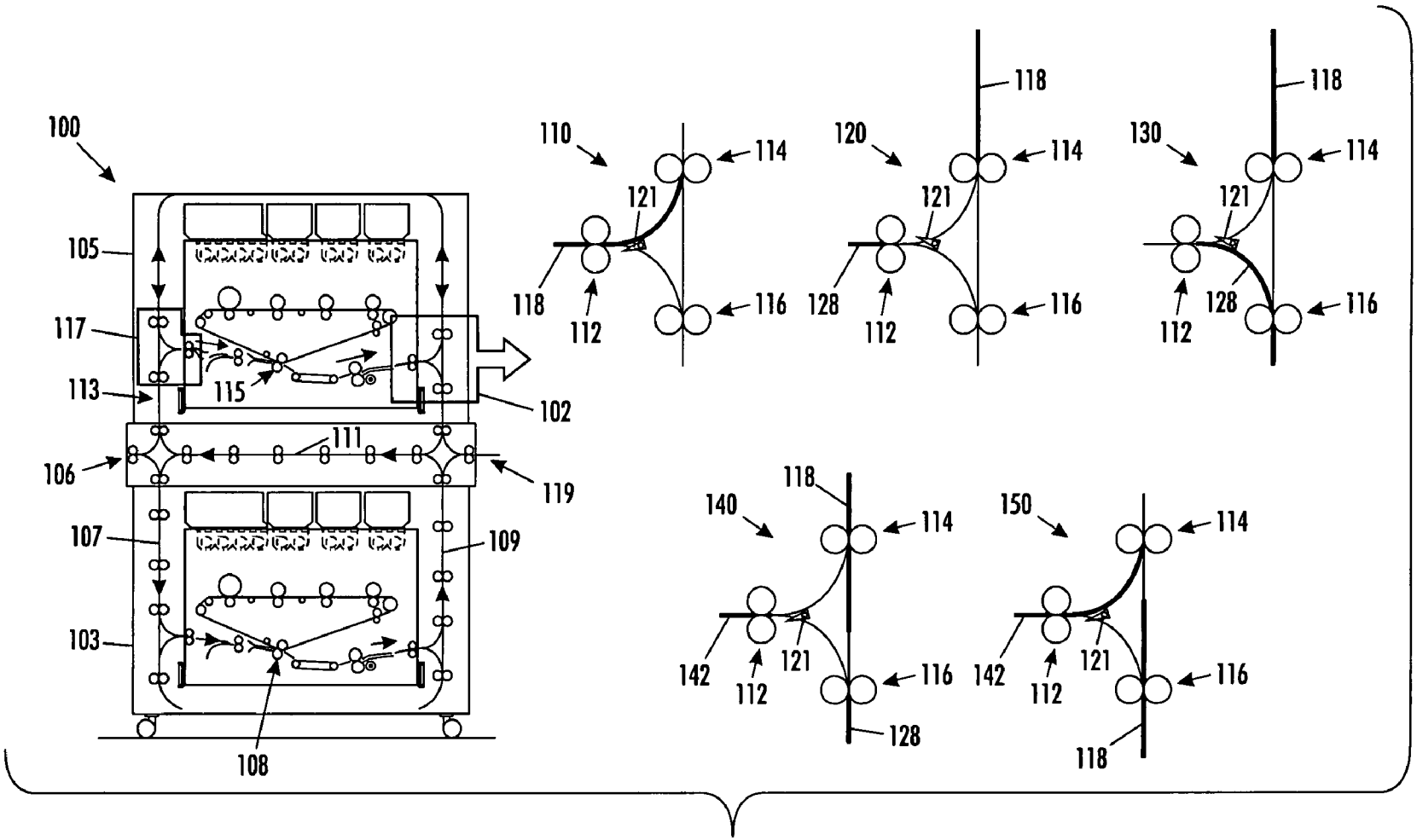
FIG. 3 illustrates an inverter apparatus and method according to another embodiment of this disclosure.

With reference to FIG. 3, illustrated are vertically integrated printing modules 100 similar to the printing module configurations described with reference to FIG. 1 and FIG. 2. To provide a facing page duplex printing operation, as previously discussed, an output inverter 102 apparatus is provided at the output of printing module 105.

The output inverter 102 document processing stages are illustrated as 110, 120, 130, 140 and 150, which are the sequential stages of output inverter 102 operation. The output inverter 102 inverts alternating printed documents.

In operation, to print a series of duplex printed documents for booklet-type binding, a first document is fed into the interface module input 106, then a second document is sequentially fed into the interface module input 106, and then a third document is sequentially fed into the interface module input 106. This rapid sequential feeding of documents continues to occur until N documents are fed into the printing system, where N is the required number of duplex printed documents for the print job.

The series of N documents are processed for duplex printing as a series, whereby document two immediately follows document one, and document three immediately follows document two, and so on. Beginning with document one, the first side of all documents is printed on printing module 103. The documents are initially routed along media path 107, through the image transfer zone 108, subsequently routed along media path 109, and then routed along media path 111. The documents are next routed to printing module 105 for printing on side two of the documents. This requires the documents to be routed along media path 113 into inverter 117, where all documents are inverted before being transported through the image transfer zone 115. Image transfer zone 115 marks an image on side two of each document as it passes, and the documents continue to travel through post image marking process, such as fusing, until reaching the output inverter 102. The output inverter 102 inverts alternating documents to provide the necessary page sequencing of the documents for facing page-type binding.

To illustrate the operation of the output inverter 102, inverter sequence diagrams 110, 120, 130, 140 and 150 are now discussed.

A first duplex printed document 118 enters the inverter 102 at input nip 112 and is directed to reversing roll nip 114 by decision gate 121. As the first document 118 is held by reversing roll nip 114 for a predetermined time, the second printed document 128 enters the inverter at input nip 112, as illustrated in diagram 120. Subsequently, as illustrated in diagram 130, document two 128 is directed to output nip 116 by decision gate 121, while the first document 118 is continued to be held by reversing roll nip 114.

With reference to diagram 140, as the second fed document 128 is processed by output nip 116, the first fed document 118 is routed towards output nip 116 and a third document 142 enters the inverter at input nip 112. As indicated in diagram 150, the first fed document 118 continues to be processed by output nip 116 and the third fed document 142 is directed to reversing roll nip 114, and the process repeats until all N documents fed into the system have been processed. As the printed documents are outputted from the output inverter 102, they are directed to the interface module output 119, where they can be routed to a finisher for stacking, binding, etc.

It should be noted, the output inverter apparatus and method described above produces a sequence of duplex printed documents represented as second fed document, first fed document, fourth fed document, third fed document, etc. Because of this inverter 102 produced sequence of documents, the printing modules are controlled to print the appropriate image on the documents. For example, the second fed document 128 includes images desired on page one and page two of a booklet-type collection of documents, and the first fed document 118 includes images desired on page three and page four of a booklet-type collection.

Figure 4:
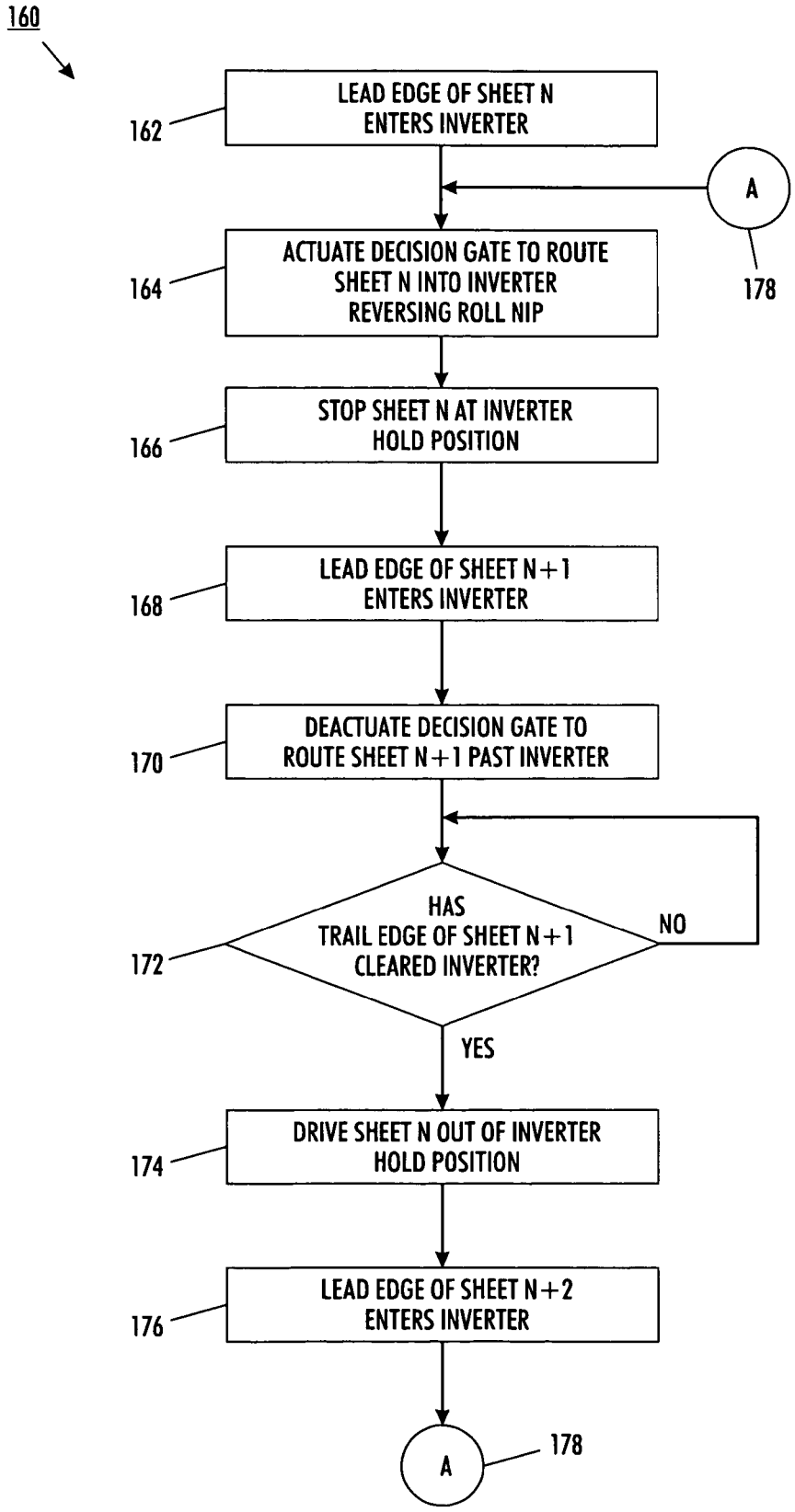
FIG. 4 illustrates method of inverting media sheets according to another embodiment of this disclosure.

With reference to FIG. 4, illustrated is an exemplary method of operating 160 an inverter according to one embodiment of this disclosure. As the first sheet, N, enters 162 the output inverter, the leading edge of the sheet is detected by a position sensor and a decision gate is actuated 164 to route sheet N into an inverter reversing roll, where sheet N is held 166 in position within the inverter.

Subsequently, the leading edge of sheet N+1 enters 168 the output inverter. The leading edge of sheet N+1 is detected by a position sensor and the decision gate is deactivated 170 to route sheet N+1 past the inverter.

After the trailing edge of sheet N+1 clears 172 the inverter, sheet N is driven 174 out of the inverter hold position and driven out of the inverter via the output nip 116. At this point, the leading edge of sheet N+2 enters 176 the inverter and the inverter cycle repeats 178.

Figure 5:
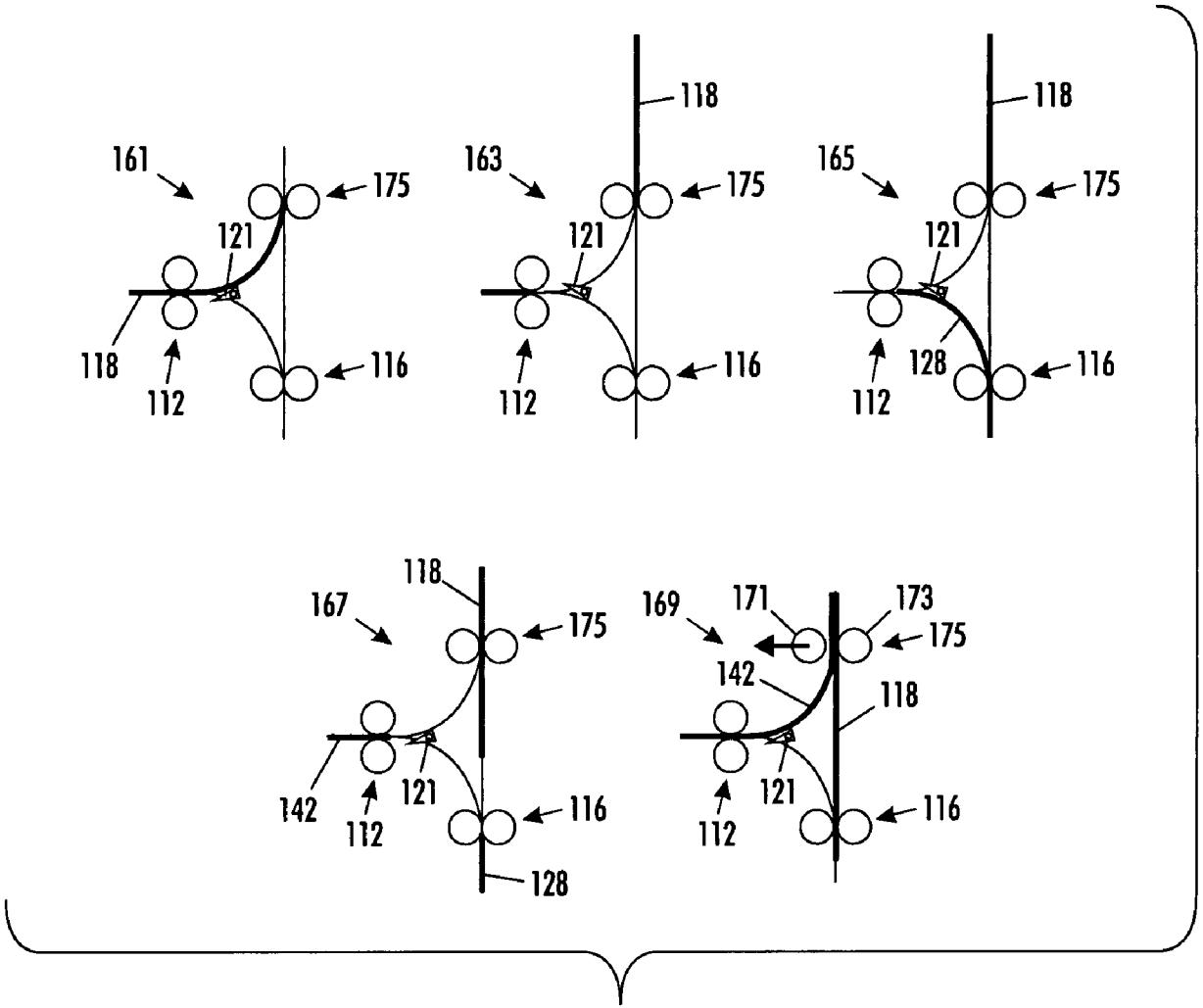
FIG. 5 illustrates an inverter apparatus and method according to another embodiment of this disclosure.

With reference to FIG. 5, illustrated is another exemplary inverter apparatus and method of operation according to an aspect of this disclosure. The inverter configuration comprises a reversing roll nip 175 including a nip split mechanism to separate rollers 171 and 173 for simultaneously receiving a document and ejecting a document, as illustrated in diagram 169.

In operation, a first duplex printed document 118 enters the inverter 102 at input nip 112 and is directed to reversing roll nip 175 by decision gate 121, as illustrated in diagram 161. As the first document 118 is held by reversing roll nip 175 for a predetermined time, the second printed document 128 enters the inverter 128 at input nip 112, as illustrated in diagram 163. Subsequently, as illustrated in diagram 165, document two is directed to output nip 116 by decision gate 121, while the first document 118 is continued to be held by reversing roll nip 175. With reference to diagram 167, as the second fed document 128 is processed by output nip 116, the first fed document 118 is routed towards output nip 116 and a third document 142 enters the inverter at input nip 112.

With reference to diagram 169, the first fed document 118 continues to be routed towards output nip 116 and the third fed document 142 is directed to reversing roll nip 175, and the process repeats until all N documents fed into the system are processed.

The nip split mechanism enables rollers 171 and 173 to separate to allow reversing roll nip 175 to contain both documents 118 and 142. In other words, the first fed document 118 exits the reversing roll nip while the third fed document 142 enters the reversing roll nip, thereby providing a reduced inverter cycle time relative to the inverter apparatus illustrated in FIG. 3.

In operation, the output nip 116 must have sufficient control of a document exiting the reversing roll before the nip split mechanism enables the reversing roll nip 175 to accept a second document from the input nip 112. This enables the reversing roll nip 175 to cease driving the exiting document and accept the second document from the input nip 142.

Figure 6:
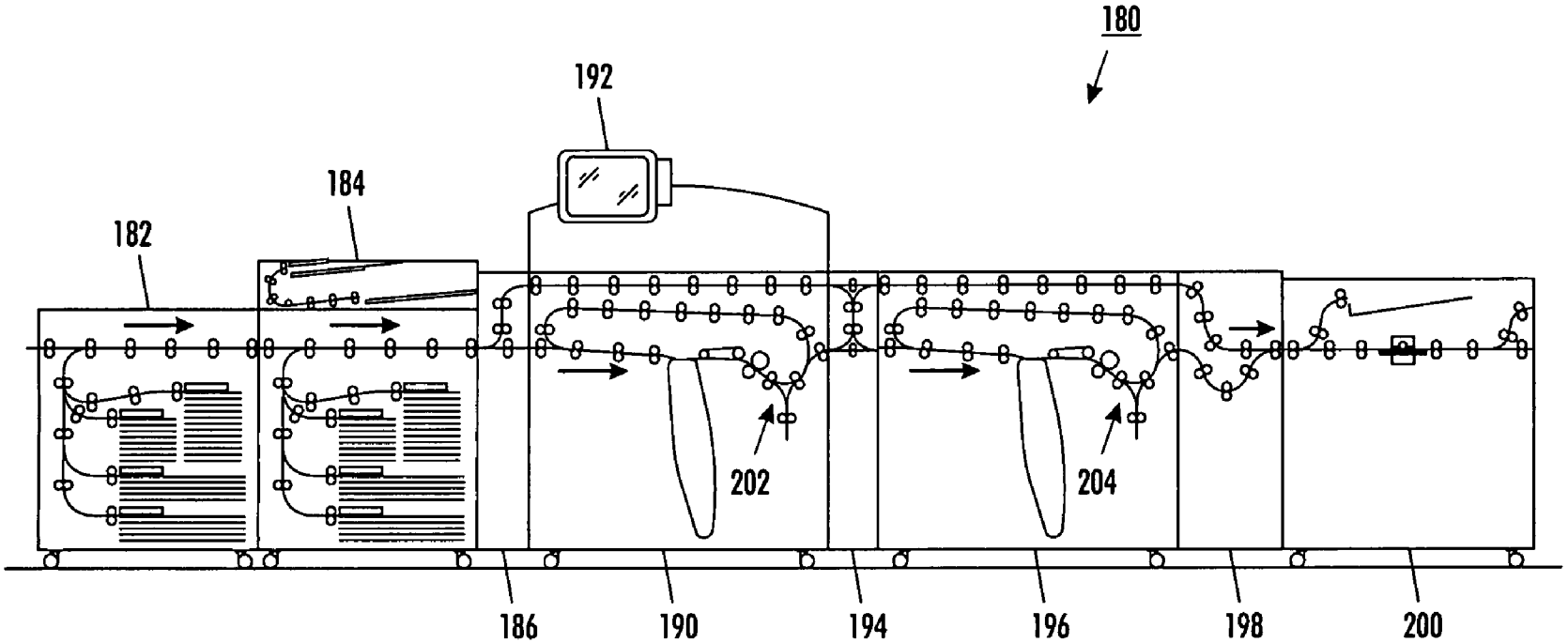
FIG. 6 illustrates a printing system according to another embodiment of this disclosure.

With reference to FIG. 6, illustrated is a printing system 180 that includes an embodiment of an inverter apparatus according to this disclosure and described above.

The printing system 180 comprises sheet feeder modules 182 and 184, printing modules 190 and 196, a finisher module 200, interface modules 186, 194 and 198, and an operator interface module 192.

Figure 7:
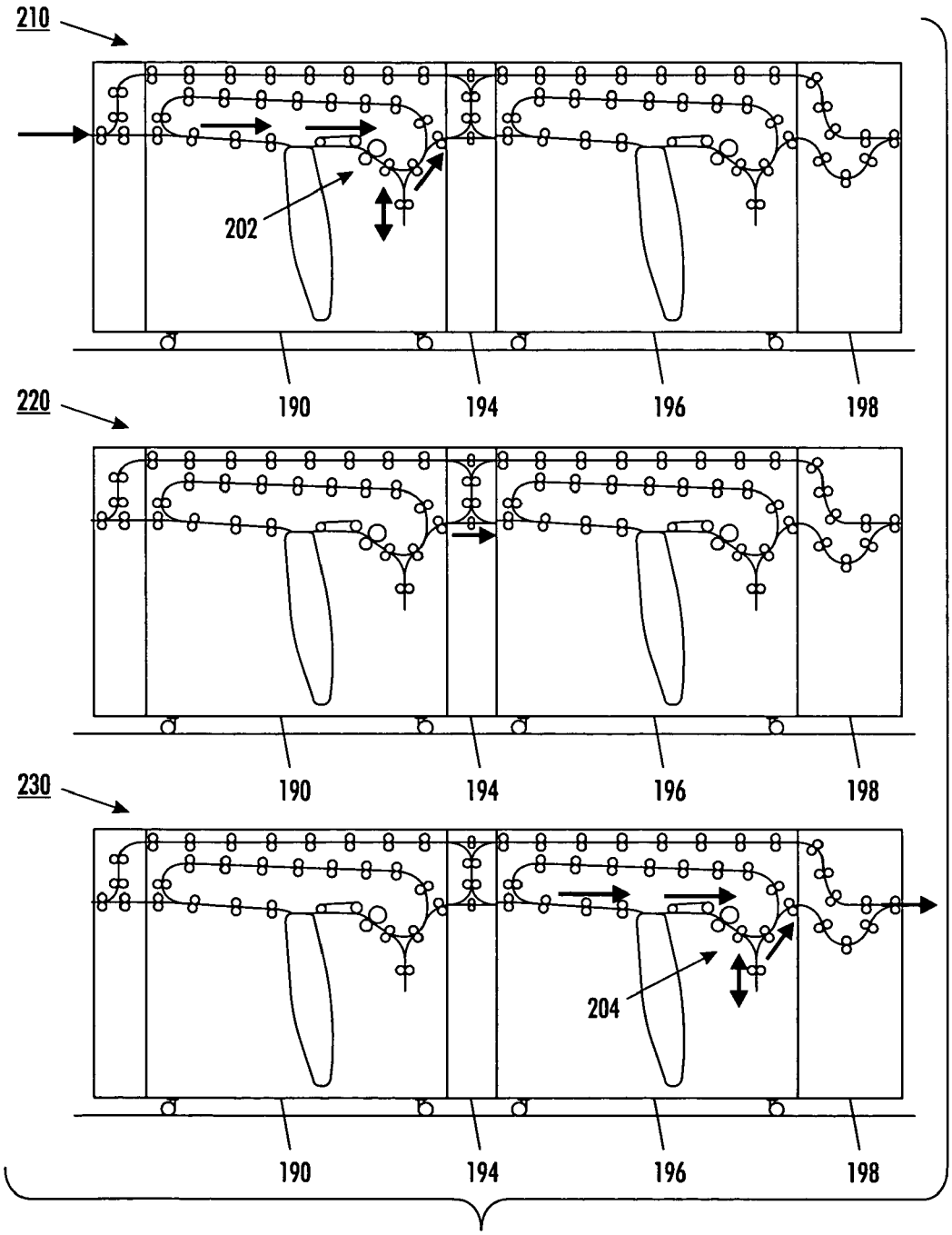
FIG. 7 illustrates a method of operating the printing system according to FIG. 5.

Printing module 190 includes an output inverter 202 and printing module 196 includes an output inverter 204. The inverters are positioned to provide an inversion of a document subsequent to image marking and prior to an image marked document exiting the respective printing modules 190 and 196. The direction of a media sheet or document flow within the printing system 180 is indicated by black arrows. FIG. 7 illustrates the flow of a document through printing module 190, interface module 194, printing module 196 and interface module 198. Diagram 210 illustrates the flow of a document through a first printing module 190 and inverter 202. Diagram 220 illustrates the flow of a document through interface module 194. Diagram 230 illustrates the flow of a document through printing module 196 and inverter 204, and interface module 198.

With continuing reference to FIG. 7, an exemplary duplex printing operation is described. This printing operation produces a sequence of printed documents with facing pages printed with the same printing module. With reference to diagram 210, media sheets enter the interface module and pass through printing module 190 for marking on side one of the documents. Subsequent to marking, each sheet is inverted such that the printed side faces upwardly. With reference to diagram 220, the sheets exit printing module 190 and are routed through the interface module 194 to the entrance of the second printing module 196.

With reference to diagram 230, the sheets pass through printing module 196 for printing on side two of the media sheet and alternate sheets are inverted by inverter 204 before passing through interface module 198 to a finisher (not shown).

Figure 8:
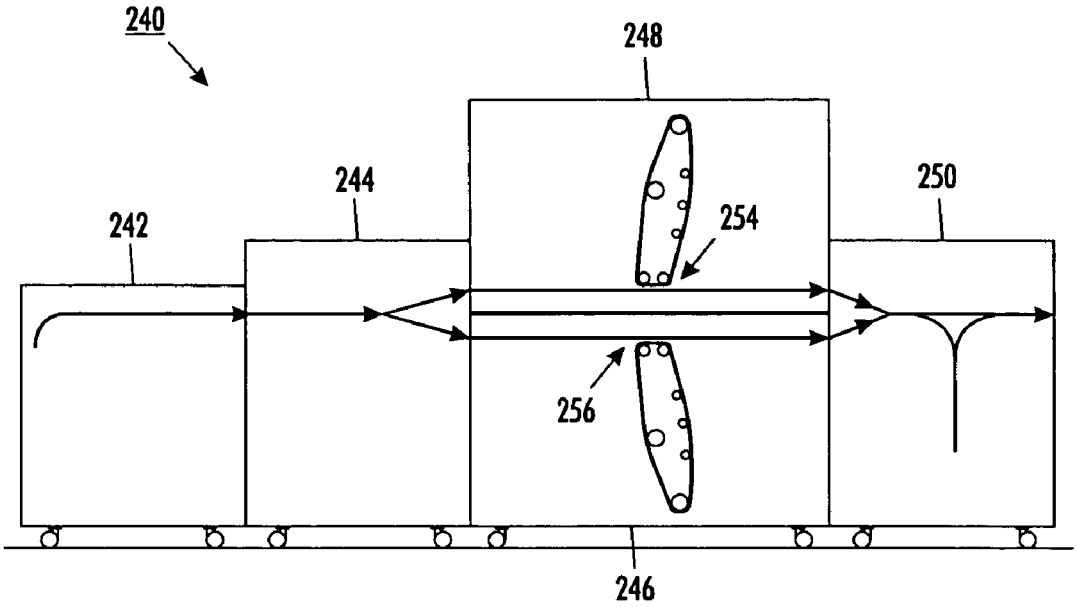
FIG. 8 illustrates a printing system according to another embodiment of this disclosure.

With reference to FIG. 8, illustrated is a simplex printing system 240 that utilizes alternate sheet inversion sequencing according to another embodiment of this disclosure. The printing system includes sheet feeder modules 242 and 244, a top-marking printer module 248, a bottom marking printing module 246, and an output inverter module 250.

As illustrated by the black arrows, sheets are top-marked at image marking zone 254 and sheets are bottom-marked at image marking zone 256. The one-sided marked sheets are merged after printing. Subsequently, alternate sheets are inverted by inverter module 250 to orient the printed side of the sheets in a common direction. The alternate inversion is done using the previously described methods in FIGS. 3-5 for maximizing printing productivity.

Figure 9:
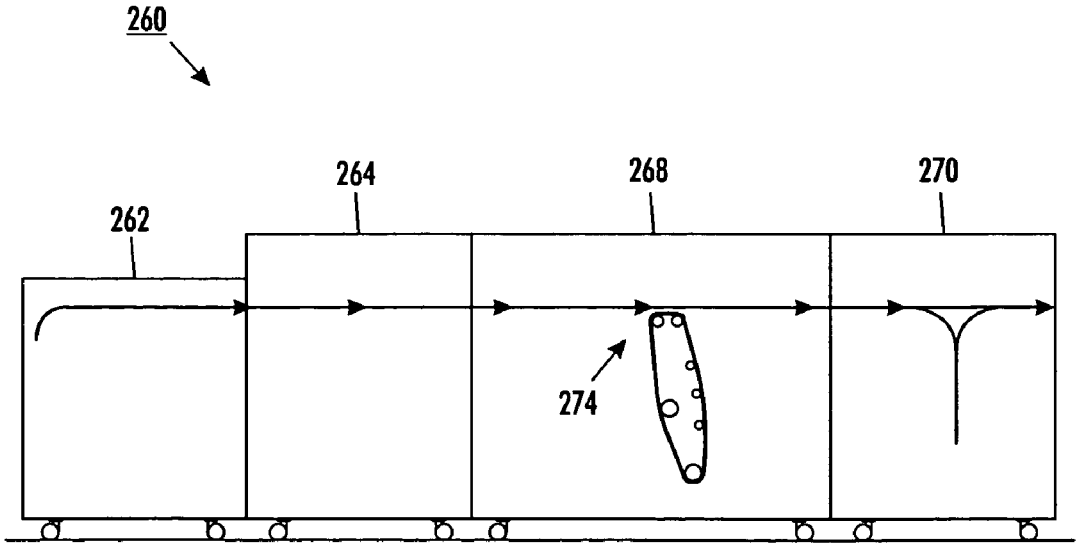
FIG. 9 illustrates a printing system according to another embodiment of this disclosure.

With reference to FIG. 9, illustrated is another simplex printing system 260 comprising a sheet feeder module 262, an interface module 264, a printing module 268 and an output inverting module 270. The printing system 260 can produce printed documents sequenced to specific leading edge and trailing edge requirements. For example, printing tabbed media sheet stock. The tabbed stock can be fed to the printing module "tabs trailing" for marking. Subsequently, the tabbed sheets are selectively inverted to produce "tabs leading" printed sheets at a finisher module (not shown). In this manner, selected sheets in the output stream of the printing system can be reoriented via inversion while maximizing printing productivity.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a first printing module comprising:

a first media sheet input configured to receive, sequentially, a first and second media sheet for marking;

a first image marking zone configured to mark a first side of the first and second media sheets, the image marking zone operatively connected to the first media sheet input; and a first media sheet inverter operatively connected to the first image marking zone, the first media sheet inverter configured to receive and invert, sequentially, the first and second media sheets routed from the first image marking zone;

a second printing module comprising:

a second media sheet input configured to receive, sequentially, the first and second media sheet for marking;

a second image marking zone configured to mark a second side of the first and second media sheets, the second image marking zone operatively connected to the second media sheet input; and a second media sheet inverter operatively connected to the second image marking zone, the second media sheet inverter configured to, sequentially, receive and invert the first media sheet, receive the second media sheet, eject the second media sheet non-inverted, and subsequently, eject the first media sheet, the second media sheet inverter comprising:

an input nip configured to receive and eject, sequentially, the first media sheet and the second media sheet;

a reversing roll nip operatively connected to the input nip and configured to rotate in a forward direction to receive the first media sheet ejected from the input nip, hold the first media sheet for a predetermined time and invert the first media sheet by ejecting the first media sheet rotating the reversing roll nip in a reverse direction; and an output nip operatively connected to the input nip and the reversing roll nip, the output nip configured to receive the first media sheet inverted and ejected from the reversing roll nip, and eject the first media sheet inverted from the output nip, and the output nip configured to receive the second media sheet non-inverted and ejected from the input nip and eject the second media sheet non-inverted from the output nip; and a printing module controller operatively connected to the first printing module and the second printing module, the printing module controller executing computer readable instructions to execute a four page duplex print job process including:

sequentially printing page one on the first side of the first media sheet using the first printing module, printing page four on the first side of the second media sheet using the first printing module, printing page two on the second side of the first media sheet using the second printing module and printing page three on the second side of the second media sheet using the second printing module, the controller executed instructions controlling the reversing roll nip to hold the first media sheet while, simultaneously, the second media sheet is ejected from the input nip to the output nip, and subsequently the first media sheet is ejected from the reversing roll nip to the output nip with an inverted orientation.

2. The printing system according to claim 1, the second media sheet inverter comprising:

a nip split mechanism operatively connected to the reversing roll nip.

3. The printing system according to claim 2, wherein the reversing roll nip is configured to simultaneously eject the first media sheet and receive a third media sheet.

4. The printing system according to claim 1, the second media sheet inverter comprising:

a decision gate configured to selectably direct the first media sheet from the input nip to the reversing roll nip and direct the second media sheet from the input nip to the output nip.

5. The printing system according to claim 4, wherein the reversing roll nip is configured to simultaneously eject the first media sheet and receive the second media sheet.

6. The printing system according to claim 5, wherein the reversing roll nip is configured to eject the first media sheet and drive the first media sheet to the output nip.

7. The printing system according to claim 1, wherein the predetermined time is equal to or greater than half of the time required for successive media sheets to arrive at the input nip.

8. The printing system according to claim 1, wherein the second media sheet inverter is configured to sequentially receive N media sheets, where N is equal to or greater than two, and invert alternating media sheets.

* * * * *